United States Patent [19]

Boyd

[11] 4,153,389

[45] May 8, 1979

[54] FAN-FAN DRIVE ASSEMBLY

[76] Inventor: Keith A. Boyd, 220 N. Marshall, Marshall, Mich. 49068

[21] Appl. No.: 871,054

[22] Filed: Jan. 20, 1978

[51] Int. Cl.[2] ..... F04D 29/32; F04D 29/64

[52] U.S. Cl. ..... 416/93 R; 416/169 A

[58] Field of Search ..... 416/93 R, 181, 39, 169 A; 123/41.11, 41.12, 41.49, 41.65

[56] References Cited

U.S. PATENT DOCUMENTS

| | | | |
|---|---|---|---|
| 2,620,970 | 12/1952 | Palmer et al. | 416/93 R |
| 3,303,995 | 2/1967 | Boeckel | 416/93 R |
| 3,385,516 | 5/1968 | Omohundro | 416/93 R |
| 3,627,445 | 12/1971 | Andriussi et al. | 416/169 A |
| 3,993,415 | 11/1976 | Hauser | 416/93 R |
| 4,064,980 | 12/1977 | Tinholt | 123/41.12 |

FOREIGN PATENT DOCUMENTS

| | | | |
|---|---|---|---|
| 2344297 | 3/1975 | Fed. Rep. of Germany | 123/41.12 |
| 1418236 | 12/1975 | United Kingdom | 416/93 R |

*Primary Examiner*—Everette A. Powell, Jr.
*Assistant Examiner*—A. N. Trausch, III
*Attorney, Agent, or Firm*—J. Yakimow; R. J. McCloskey

[57] ABSTRACT

A plastic fan configured for attachment to a fan drive in a manner in which cooling air will be promoted to flow from the rear of the fan drive across the rear fins of the fan drive and through the blades of the fan. The flow of air across the rear fins increases heat dissipation from the fan drive. The fan has a plurality of radially extending circumferentially spaced blades secured to an axially extending hub portion. The hub portion is configured to be radially spaced from the fan drive to define an annular passage. Further, the front edge of the hub portion is spaced rearwardly from the forward portion of the rear fins of the fan drive to define a slot for cooling air to flow substantially unrestricted through the annular passage and to the blades of the fan.

13 Claims, 4 Drawing Figures

FAN-FAN DRIVE ASSEMBLY

FIELD OF THE INVENTION

The invention relates to an assembly including a plastic fan having radially extending blades attached to an axially extending hub portion that: encircles; is radially spaced from; and is secured to a fan drive via a metal spider.

DESCRIPTION OF THE PRIOR ART

It is well known to make a viscous fan drive containing viscous fluid to transfer torque from an input member driven by an internal combustion engine of a vehicle to an output member that supports a fan. Viscous shear between the input and output members, due to rotational slippage, causes shear torque transfer to the output member resulting in an increase of viscous fluid temperature.

It is also well known to make plastic fans for cooling the internal combustion engine. These fans include an axially extending annular hub portion which supports a plurality of radially extending blades. In certain applications, a metal spider or the like is provided to attach the hub portion in encircling relationship to the viscous fan drive. Certain of these known applications are illustrated in U.S. Pat. Nos. 3,622,249; 3,642,382; and 3,993,415; and in U.S. patent application Ser. No. 800,374, filed May 25, 1977 and assigned to the assignee of the present invention.

In order not to overheat the viscous fluid, the heat resulting from rotational slippage must be dissipated from the fan drive. Radially extending fins are provided on the front and/or rear faces of the fan drive to transfer heat from the fluid to the atmosphere. Ambient air is drawn across these fins to increase this heat transfer thus resulting in improved cooling of the fan drive.

However, when a known plastic fan is employed with a viscous fan drive, the axially extending hub of the plastic fan forms a shroud which encircles the fan drive and substantially encircles the fins. It has been determined by applicant that the shroud formed by the hub reduces the ability of the fins to dissipate the heat from the fan drive to the atmosphere.

SUMMARY OF THE INVENTION

It is, accordingly, an object of the present invention to overcome the disadvantages in the prior art fan-fan drive assemblies by providing a plastic fan for use with a fan drive that will provide a cooling level for an internal combustion engine which is equal to or greater than known assemblies while increasing heat dissipation from the fan drive.

The foregoing object is accomplished in one embodiment by providing a viscous fan drive having radially extending fins on its front and rear faces and a plastic fan having an axially extending hub portion encircling the fan drive and supporting radially extending blades, the front edge of the hub portion being located rearwardly of the radially outermost portion of the rear fins and the front edge of the fan blades being located forwardly of the radially outermost portion of the rear fins.

DETAILED DESCRIPTION OF THE DRAWINGS

Figure 1:
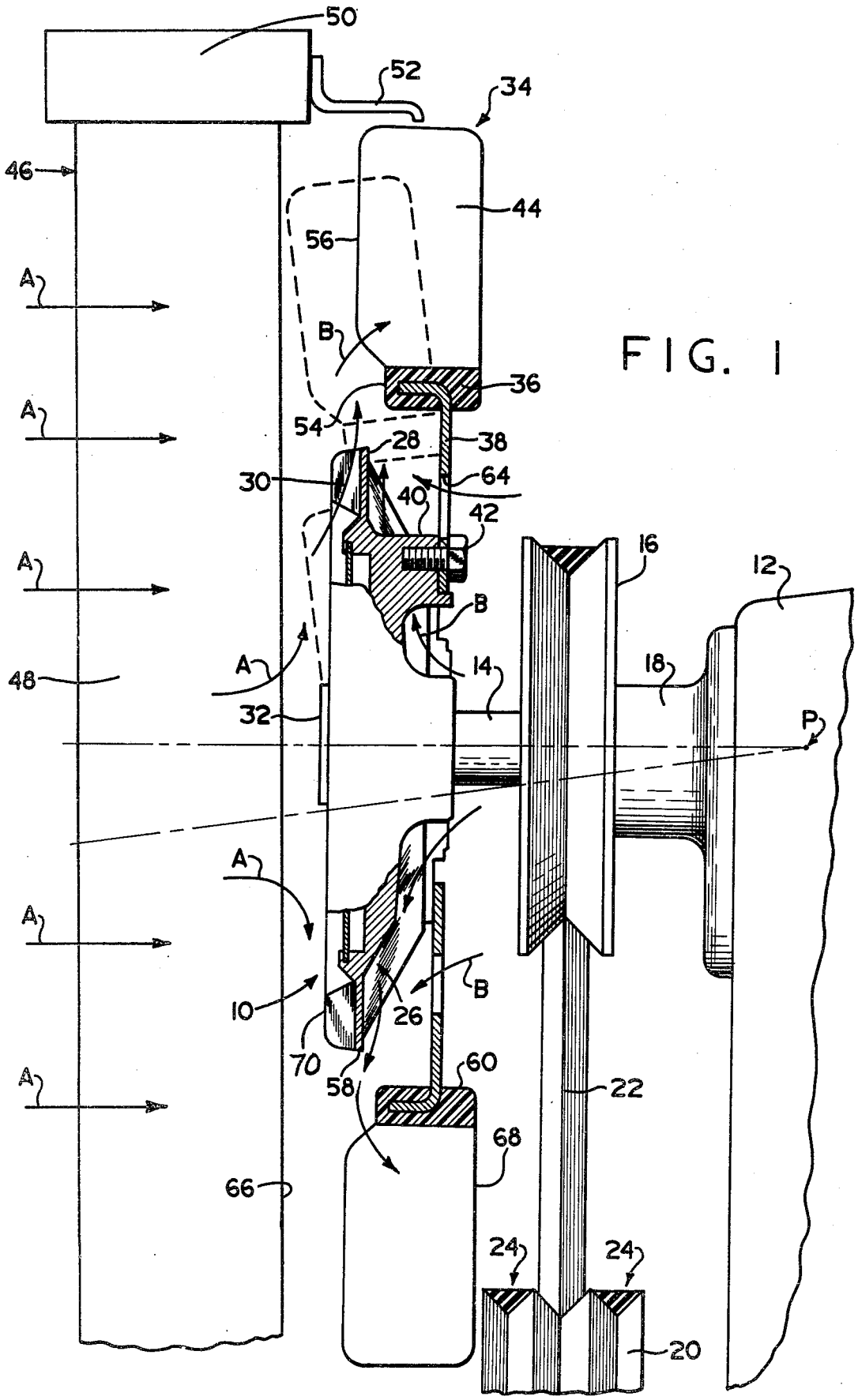
FIG. 1 illustrates a fan-fan drive assembly according to the invention mounted relative to a radiator of an internal combustion engine of a vehicle.

In FIG. 1, a viscous fan drive 10 is supported from an internal combustion engine 12 via a shaft 14. Shaft 14 is rotated by pulley 16 that also rotates a water pump 18. A pulley 20 rotated by engine 12 rotates pulley 16 via a belt 22. Belts 24 rotate other accessories of the vehicle in which engine 12 is mounted.

Viscous fan drive 10 is similar to the one illustrated in U.S. Pat. No. 3,272,292 and includes a plurality of radially disposed rear fins 26. Rear fins 26 direct cooling air B across the rear face of drive 10 and terminate at a radially outermost portion 28. On the front face of drive 10 is located a plurality of front fins 30 disposed at an angle relative to a radial projection. Fins 30 direct cooling air across the temperature sensing element 32 located on the axis of shaft 14 and dissipate heat from drive 10. A fan 34 made of a plastic material, such as, polypropolene or nylon, includes an annular axially extending hub portion 36 having embedded therein a metal annular spider 38 which is secured at four locations 40 on the rear face of drive 10. Bolts 42 projecting in threaded openings are used to secure spider 38 to drive 10 in a known manner. Projecting from hub 36 and molded integrally therewith are a plurality of circumferentially spaced radially extending fan blades 44.

The fan-fan drive assembly is located proximate a radiator 46 which has a heat dissipating core 48 and a liquid reservoir 50. Shrouding 52 circumferentially encircles fan 34. As indicated by the arrows A in FIG. 1, air is drawn through core 48 by blades 44. The specification so far has merely described well known components mounted in a known manner within the engine compartment of a vehicle.

Applicant has determined that it is necessary that the front edge 54 of hub 36 be located rearwardly of outermost portion 28 of rear fins 26. Further, it is desirable, but not necessary, to have the front edge 56 of blades 44 located forwardly of outermost portion 28 of rear fins with the front edge preferably lying in a plane which passes through a portion of fins 30. It is also necessary to maintain a given radial clearance between the outer circumferential surface 58 of drive 10 and the inner circumferential surface 60 of hub 36. The foregoing construction insures that adequate cooling air A is drawn through core 48 and that a secondary flow of air B is also created around fins 26 of drive 10. The secondary flow of air B aids in the increase of heat transfer from the fluid within drive 10 to the atmosphere.

Figure 4:
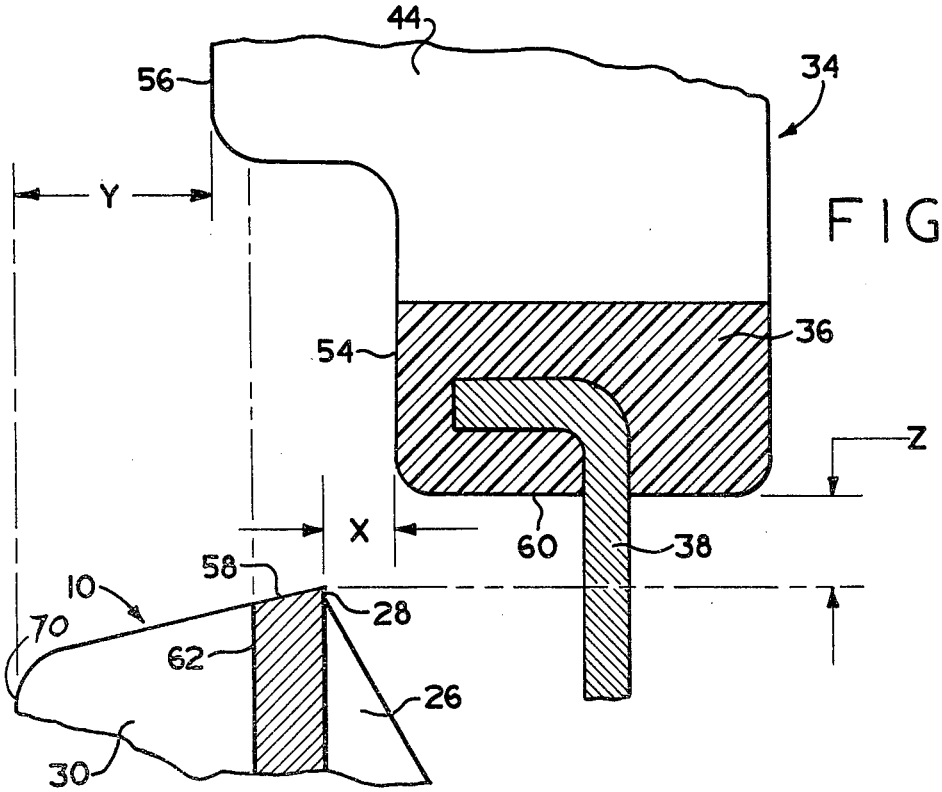
FIG. 4 is an enlarged view of an alternate embodiment of the assembly illustrating the relationship of the fan relative to the fan drive.

The significance of certain dimensions may best be illustrated with reference to an alternate embodiment of the invention illustrated in FIG. 4. In a preferred arrangement, an axial distance X of 0.2 inches (0.51 cm) should be provided between outermost portion 28 of rear fins 26 and the front edge 54 of hub 36. It is also desirable to provide an axial dimension Y of 0.5 inches (1.27 cm) between the front edge 56 of blades 44 and the rear edge 62 of front fins 30. It is also necessary to have a given radial dimension Z of 0.2 inches (0.51 cm) between outer circumferential surface 58 of drive 10 and inner circumferential surface 60 of hub 36. The given dimensions X, Y, and Z are only significant in reference to a fan-fan drive assembly having a diameter of approximately 6 inches (15.24 cm) for surface 58; approximately 6.4 inches (16.26 cm) for surface 60; and approximately 15 inches (38.1 cm) for the outer diameter of blades 44.

The dimensions X and Z insure the formation of an annular air flow passage between hub 36 and fan drive 10. The annular passage is configured to allow for substantially unrestricted radial air flow B from rear fins 26 past the front edge 54 of hub 36. Further, it is preferred, but not necessary, to have the blades 44 overlap the annular passage defined by dimensions X and Z to draw the air B through the annular passage and radially and axially through blades 44 in a manner to allow for a substantially unrestricted flow of air B away from the annular passage.

Figure 2:
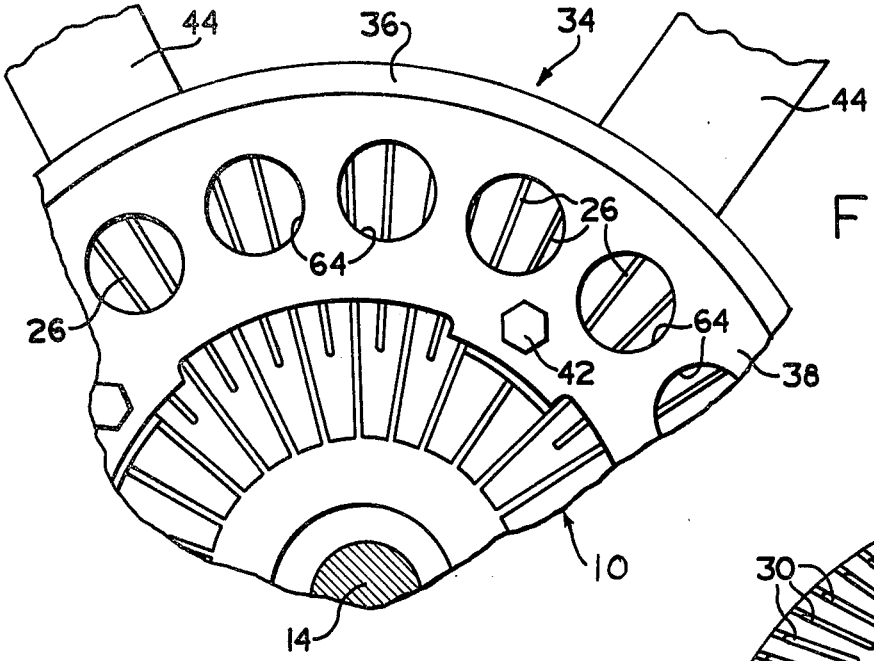
FIG. 2 illustrates a portion of the rear face of the fan drive illustrated in FIG. 1.
Figure 3:
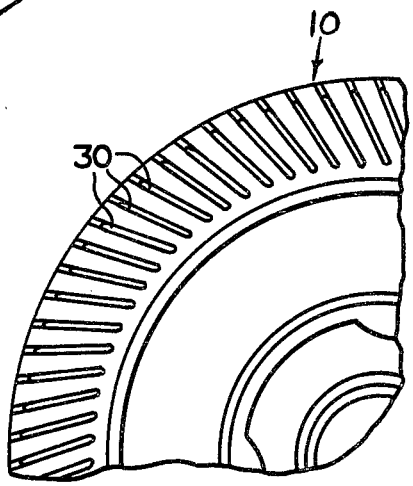
FIG. 3 illustrates a portion of the front face of the fan drive illustrated in FIG. 1.

In order to insure for this flow of air from the rear of the assembly, it is necessary to provide a plurality of circumferentially spaced openings 64 in metal spider 38. It is further desirable to terminate rear fins 26 at the rear edge of fan drive 10 radially inwardly from spider 38 in the manner illustrated in FIGS. 1 and 2.

Although it is desirable to use front fins 30, many viscous fan drives are produced without such fins. Without such fins 30, it is even more significant to provide adequate heat transfer from rear fins 26 of drive 10. In these latter applications, it is desirable to employ the spaces X and Z indicated in FIG. 4. Space Y, which is optional but preferred, would be measured from the front face 62 of drive 10 to edge 56 of fan 34 and would be substantially less than the dimension set forth for the example previously referenced.

Due to the demand for smaller vehicles, space within an engine compartment is being reduced. Limitations are placed upon the distance between front edge 56 of blades 44 and the rear surface 66 of radiator 46. The location of the rear edge 68 of blades 44 is generally limited by pulleys 20 and other engine accessories. Accordingly, the axial dimension of the fan-fan drive assembly is severely restricted. Further, engine 12 is generally free to pivot about 7½ degrees about a pivot point P in a normal vehicle installation. Applicant has determined that he can accomplish his cooling objectives without overheating the fan drive by the foregoing described arrangement. He has further determined that it is advantageous in certain installations where front fins 30 are used on fan drive 10 to locate the front edge 70 of front fins 30 forwardly of front edge 56 of blades 44. As illustrated in the dashed lines in FIG. 1, the locations of front edges 56 and 70 allow for pivotal movement of the fan-fan drive assembly without contact being made between front edges 56 and 70 and rear surface 66 of radiator 46. Each blade 44 must have a given pitch providing for a given axial distance between front edge 56 and rear edge 68 to assure an adequate flow of air A through radiator 46.

The invention is primarily directed toward the use of molded plastic fans in combination with a viscous fan drive. It is, however, contemplated that other fan drives, for example, friction fan drives, electro-magnetic fan drives, or wet or dry clutch fan drives, which have heat producing characteristics, may also employ the inventive concepts set forth in the foregoing description.

What is claimed is:

1. A fan-fan drive assembly for cooling the prime mover of a vehicle comprising:

(a) a fan rotatable about an axis and made of plastic, said fan including
  1. an axially extending annular hub portion having an inner circumferential surface, a front edge lying in a generally radially extending plane, and a rear edge, and
  2. a plurality of radially extending fan blades secured to said hub and each having a front edge lying in a generally radially extending plane and a rear edge;

(b) fan drive means to rotate said fan about said axis, said fan drive means including
  1. a front face,
  2. a rear face axially spaced from said front face and having a plurality of radially extending cooling fins each terminating at a forwardly located radially outermost portion that lies in a generally radially extending plane, and
  3. an outer circumferential surface configured to be fit within and radially spaced from said inner circumferential surface of said fan to define an annular passage between said inner and outer circumferential surfaces; and (c) means securing said fan in axially fixed encircling relationship to said fan drive to locate said plane of said outermost portion of said rear fins forwardly of said plane of said front edge of said hub and to define said annular passage.

2. A fan-fan drive assembly according to claim 1 wherein said hub encircles a portion of said rear fins.

3. A fan-fan drive assembly according to claim 2 wherein said rear edge of said hub lies axially rearwardly of said rear fins of said fan drive.

4. A fan-fan drive assembly according to claim 2 wherein said plane of said front edge of said blades lies axially forward of said plane of said outermost portion of said rear fins.

5. A fan-fan drive assembly according to claim 4 wherein said rear edge of said blades and said rear edge of said hub portion lie substantially in a radially extending plane.

6. A fan-fan drive assembly according to claim 4 further including front radially extending fins located on said front face and having a front edge lying in a generally radially extending plane.

7. A fan-fan drive assembly according to claim 6 wherein said plane of said front edge of said front fins is located axially forward of said plane of said front edge of said blades.

8. A fan-fan drive assembly according to claim 1 wherein said securing means include an annular spider made of metal and having a plurality of circumferentially spaced openings located adjacent said rear fins of said fan drive to allow for the flow of air from the rear of said fan-fan drive assembly to said rear fins.

9. A fan-fan drive assembly according to claim 8 wherein said spider is releasably secured to said fan drive and is rigidly fixed to said hub portion of said fan.

10. A fan-fan drive assembly according to claim 1 wherein said fan drive is a temperature responsive viscous fan drive having a temperature sensing element on said front face.

11. A fan-fan drive assembly according to claim 10 further including front radially extending fins located on said front face and having a front edge lying in a generally radially extending plane that is located axially forward of said plane of said front edge of said blades.

12. A fan to cool the prime mover of a vehicle and be releasably secured to a fan drive that is rotatable about an axis and has a front face, a rear face axially spaced from said front face and including a plurality of radially extending cooling fins each terminating at a radially outermost portion that lies in a generally radially extending plane, and an outer circumferential surface, said fan comprising:

(a) an axially extending annular hub portion made of plastic and having an inner circumferential surface that is configured to encircle said outer circumferential surface of said fan drive and define therewith an annular passage between said inner and outer circumferential surfaces, said hub having a front edge lying in a generally radially extending plane;

(b) a plurality of radially extending fan blades made of plastic and secured to said hub, each blade having a front edge lying in a generally radially extending plane that is located forwardly of said plane of said front edge of said hub; and (c) annular spider means made of metal and rigidly secured to said hub and adapted to be releasably secured to said fan drive to locate said plane of said front edge of said hub portion axially rearwardly of said plane of said outermost portion of said rear fins and to define said annular passage between said inner and outer circumferential surfaces.

13. A fan according to claim 12 further including a plurality of spaced openings in said spider.

* * * * *